United States Patent [19]

Yamada et al.

[11] Patent Number: 4,801,405

[45] Date of Patent: Jan. 31, 1989

[54] COMPOSITION FOR IMPARTING FIRE-RETARDANT PROPERTIES TO POLYESTER FIBERS

[76] Inventors: Mamoru Yamada, 1-2-8-1103 Tsurumi, Tsurumi-ku, Osaka-shi, Osaka-fu; Takeo Tanaka, 14-14 Kamisatotorimi-cho, Oharano, Nishikyo-ku, Kyoto-shi, Kyoto-fu, both of Japan

[21] Appl. No.: 35,800

[22] Filed: Apr. 8, 1987

[30] Foreign Application Priority Data

Apr. 11, 1986 [JP] Japan ..... 61-82221

[51] Int. Cl.[4] ..... C09K 21/00; C09D 5/16; C09D 5/18; C08K 5/02

[52] U.S. Cl. ..... 252/609; 8/115.54; 8/115.56; 8/DIG. 4; 106/18.11; 106/18.24; 106/18.35; 252/608; 260/DIG. 24; 524/464; 524/467; 524/469

[58] Field of Search ..... 252/609, 608, 601; 428/920–921; 106/15.05, 18.11, 18.24, 18.35; 8/115.54, 115.56; 528/85; 524/583; 521/907; 524/314, 317, 319, 375, 376, 380, 427, 443, 464–465, 467, 469

[56] References Cited

U.S. PATENT DOCUMENTS

| | | | |
|---|---|---|---|
| 3,522,331 | 7/1970 | Dever et al. | 252/609 |
| 3,660,346 | 5/1972 | Gray et al. | 252/609 |
| 3,779,953 | 12/1973 | Papa et al. | 252/609 |
| 3,904,700 | 9/1975 | Wolford et al. | 524/583 |
| 3,907,722 | 9/1975 | Papa et al. | 528/85 |
| 4,092,337 | 5/1978 | Jager et al. | 252/609 |
| 4,116,702 | 9/1978 | Rohringer et al. | 252/609 |
| 4,298,509 | 11/1981 | Fochesato | 524/416 |
| 4,394,306 | 7/1983 | Ravey | 252/609 |

OTHER PUBLICATIONS

Fiber Science, vol. 25, No. 1, Jan. 1, 1983.

*Primary Examiner*—Howard J. Locker
*Attorney, Agent, or Firm*—Armstrong, Nikaido, Marmelstein & Kubovcik

[57] ABSTRACT

There have been provided hard-to-combustion property impartation agents for polyester fibers. The agent is prepared by dissolving an alkyl cyclohexane containing bromine atoms in a solvent and dripping the solution into a liquid to provide an emulsion or dispersion of alkyl cyclohexane containing bromine.

7 Claims, 1 Drawing Sheet

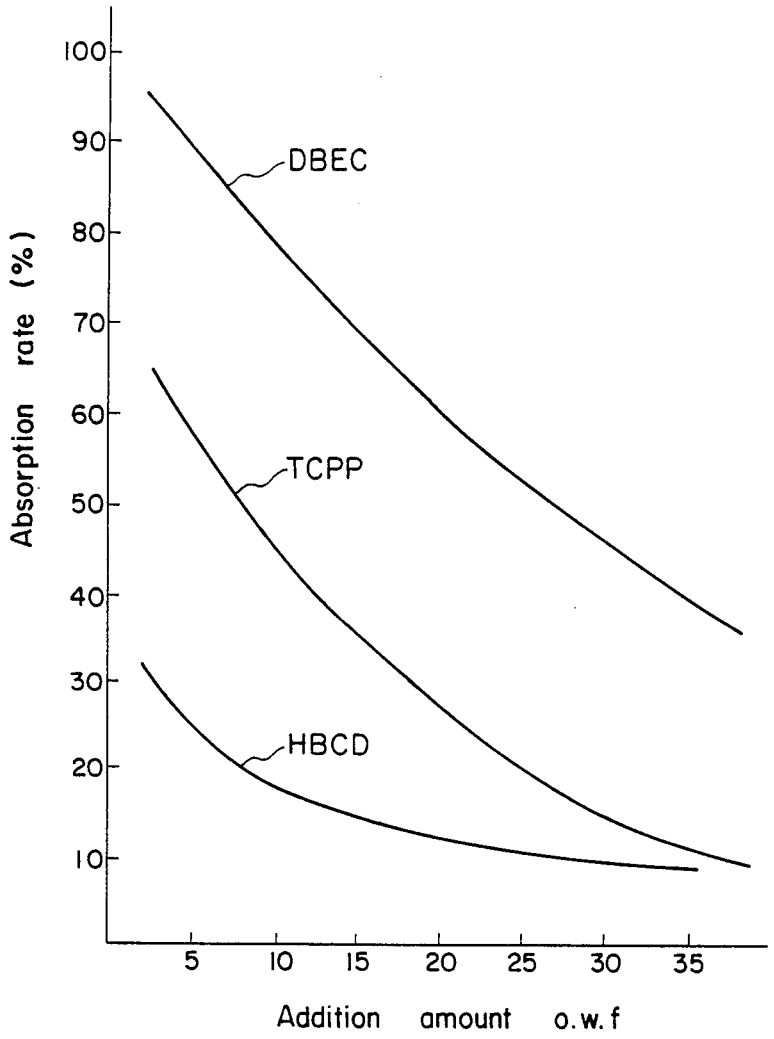
DBEC : 1,2-dibrom-4-(1,2-dibrom ethyl) cyclohexane
TCPP : Tris (2,3-dichloro propyl) phosphate
HBCD : Hexabrom cyclododecane

COMPOSITION FOR IMPARTING FIRE-RETARDANT PROPERTIES TO POLYESTER FIBERS

BACKGROUND OF THE INVENTION

1. Field of the Art

This invention relates to compositions for imparting fire-retardant properties to polyester fibers.

Imparting fire-retardant properties to fiber products has been already regulated for certain applications of the fiber products. Fiber products which are required to be rendered fire-retardant include a wide variety of fiber products such as curtains, tents, awnings, sheets, interior ornaments, decorations, automobile interior articles and garments, or example. Impartation of fire-retardant properties to such fiber products is to minimize casualties due to fires by reducing the number of sources of fire occurrence or preventing fires from spreading.

2. Prior Art

Impartation of fire-retardant properties to fiber products can be performed by the so-called temporary deposition method in which a fire-retardant agent is caused to temporarily adhere to fibers or the permanent deposition methods (1) the fire-retardant agent is caused to chemically react with the fibers, (2) the agent is applied to fibers by means of resin, (3) the agent is caused to permeate into fibers by means of the so-called high temperature and pressure or carrier dyeing and (4) the agent is forced into fibers.

As to agents for imparting fire-retardant properties to polyester fibers as a post-treatment for the fibers, a variety of alkylphosphoric esters containing chlorine or bromine have been employed and such agents include, for example, (1) tris(2,3-dibromopropyl)phosphate, tris(2,3-dichloropropyl)phosphate and trischloroethyl phosphate, (2) condensed phosphoric esters containing bromine or chlorine, (3) aromatic systems such as hexabromobenzene, tetrabromotoluene and decabromodiphenyl ether and (4) as aliphatic system, cycloalkane such as hexabromocyclododecane. Any one member selected from the above-listed fire-retardant agents is dispersed in water or an emulsifying agent. The agent dispersed in the liquid is added to a high temperature and pressure dyeing bath or ambient pressure carrier dyeing bath for dyeing polyester fibers and the resulting dyeing bath is applied to polyester fibers to dye and at the same time to impart fire-retardant properties to the polyester fibers. According to another prior art method for imparting fire-retardant properties to polyester fibers, the polyester fibers are immersed in a liquid in which a fire-retardant agent is dispersed or emulsified and then cured at a temperature in the range of 170°–195° C. for 30–90 seconds to thereby permeate or distribute the agent into the fibers.

However, the above-mentioned prior art methods and agents for imparting fire-retardant properties to polyester fibers have their inherent many drawbacks in treating polyester fibers. That is, most of alkylsulfuric esters exhibit high virulence for human bodies and some of the esters are mutagenic and carcinogenic. And when alkylsulfuric ester is used for imparting fire-retardant properties to polyester fibers, since an emulsion of the ester is added to a dyeing bath, the emulsified ester obstructs the absorption of the dyestuff in the dyeing bath into polyester fibers and thus, the dyestuff may not be applied to the polyester fibers in an intended amount.

Also when alkylsulfuric ester is employed for imparting fire-retardant properties to polyester fibers by the thermosol process, the treated polyester fibers exhibit a peculiar oily touch resulting in substantial reduction of the quality of the fibers. The most important drawback inherent in the prior art fire-retardant agents is that they substantially reduce the color fastness and especially, the sun fading resistance of the treated polyester fibers.

Aromatic bromine compounds as fire-retardant agents are very low in the absorption rate into polyester fibers and difficult to be deposited on the fibers in an amount sufficient to impart fire-retardant properties to the fibers. Thus, the aromatic bromine compounds are not suitable as the fire-retardant agents for polyester fibers. Aliphatic halogen compounds are dispersed in water and added to a dyeing bath or the compounds are employed by the thermosol method. Although the compounds are dispersed in water to be added to a dyeing bath or employed by the thermosol method and have less adverse effect on the treated polyester fibers, the absorption rate of the compounds into the fibers as determined by the dyeing bath absorption determination method is quite low such as about 25% with the employment of the agents by 5.0% o.w.f. (of the weight of polyester fibers to be treated) and the use of the aliphatic halogen compounds as fire-retardant agents for polyester fibers is uneconomical. And since the absorption rate of aliphatic halogen compound into polyester fibers is low as mentioned above, a portion of the hard-to-combustion property impartation agent tends to contaminate the dyeing machine and dyestuff liquid circulation pipe or pipes employed and ultimately, deposits itself on the wall or walls of the machine and/or pipe or pipes in the form of scale which interferes with the succeeding dyeing operations. Furthermore, since a substantial portion of the fire-retardant agent is not dissolved, but dispersed in the liquid, the agent can not be employed in atomizing type and cheese dyeing machines because the agent develops the so-called filtering phenomenon in such machines.

SUMMARY OF THE INVENTION

The inventors have endeavored to find out fire-retardant agents and methods which overcome the drawbacks inherent in the prior arts referred to hereinabove and reached the present invention.

Alkyl cyclohexanes containing bromine useful in the hard-to-combustion property impartation agents of the present invention include, for example, 1,2-dibromo-4(1,2-dibromoethyl)cyclohexane, 1,2-dibromo-4-(2,2-dibromopropyl)cyclohexane, 1,2,5-tribromo-4-(1,2-dibromoethyl)cyclohexane, 1,2,5-tribromo-4-(2,2,3-tribromobutyl)cyclohexane, 2-bromo-4-(2,2,3-tribromobutyl)cyclohexane, 1,2,5-tribromo-4-(bromomethyl)cyclohexane and 1,2-dibromo-4-dibromomethyl)-cyclohexane. Any one member selected from the above-listed bromine-containing alkyl cyclohexanes is emulsified in a suitable amount of solvent and an emulsifying agent or the selected bromine-containing alkyl cyclohexane present in the form of fine particle on the order of 1–10 microns in the liquid. The particle form fire-retardant property impartation agent is suspended in a suitable dispersion medium. The dispersed fire-retardant agent is then added to a high temperature and pressure dyeing bath or an ambient pressure carrier dyeing bath whereby the agent can impart a durable fire-retardant properties to polyester fibers while eliminating the drawbacks inherent in the prior art hard-to-combustion property impartation agents referred to hereinabove. That is, when the inventive fire-retardant agent is added to the high temperature and pressure dyeing bath, the absorption rate of the agent into polyester fibers to be treated is 85–95% of the amount thereof added to the dyeing bath which is substantially higher than the absorption rate of the agent into polyester fibers when hexabromocyclododecane or tris(2,3-dichloropropylphosphate) is added to the dyeing bath. That is, the absorption rate of the former is 25–35% and that of the latter is 45–50%, respectively, of the amount of the agent added to the dyeing bath.

The high absorption rate obtained by the use of the inventive fire-retardant agent eliminates the drawbacks of the prior art agents such as contamination of dyeing machine walls and/or dyeing liquid circulation pipes by the agent remaining in the dyeing bath. Furthermore, the high absorption rate also contributes to reduce the amount of BOD and/or COD in waste water. The other advantages obtainable by the addition of the inventive fire-retardant agent is that the agent does not interfere with the absorption of dyestuff into polyester fibers in both the high temperature and pressure dyeing and ambient pressure dyeing methods. Therefore, the intended final dyestuff deposition amount can be easily attained by the inventive fire-retardant agents. In addition, the warious color fastnesses such as sun fading resistance, wear resistance and sublimation resistance of treated polyester fibers will not be substantially adversely affected by the use of the inventive fire-retardant agents.

Surface active agents to be used in conjunction with the above-mentioned alkyl cyclohexanes containing bromine include lignin sulfonate, aromatic sulfonate, naphthalene sulfonate or esters of the sulfonates, formalin condensate, alkyl phenol, higher fatty acid and higher alcohol with ethylene oxide added thereto and one or more of the surface active agents are used in their water dispersed or emulsified form.

In order to maintain any of the surface active agent liquids in a stabilized state, any one of polymeric compounds such as carboxymethyl cellulose, polyvinyl alcohol, methyl cellulose, casein, glue and alginic acid can be used as the stabilizers.

The above and other objects and attendant advantages of the present invention will be more readily apparent to those skilled in the art from the following detailed description thereof.

According to the present invention, there has been provided an agent for imparting fire-retardant properties to polyester fibers which comprises a brominated alkyl cyclohexane represented by the general formula:

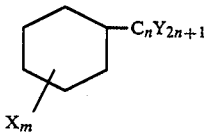

wherein X and Y are bromine or hydrogen atom, m is an integer of 1–3 and n is an integer of 1–4; and at least one surface active agent.

BRIEF DESCRIPTION OF THE DRAWING

The sole FIGURE of the accompanying drawing is a graph showing the results of comparative tests for determining absorption rates of the inventive and prior art fire-retardant agents.

The inventive fire-retardant agents are employed in amounts of 2–10% by weight and preferably, 3–6% by weight based on the weight of polyester fibers to be treated.

EXAMPLES

The present invention will be now described in detail by way of specific examples thereof which illustrate the invention, but not limit the scope of the same in any way.

EXAMPLE 1

250 g of toluene and 50 g of NONIPOL 100 (trade name, produced by Sanyo Kasei Kogyo Co., Ltd.) are added to 400 g of 1,2-dibromo-4-(1,2-dibromoethyl)cyclohexane and the materials are fully stirred until the cyclohexane and NONIPOL 100 are uniformly dissolved in the toluene to provide a solution. In a separate step, 500 ml of water is placed into a beaker of 1 liter capacity having a homogenizer. The above-mentioned solution is dripped into the beaker under agitation by the homogenizer to provide an emulsion.

EXAMPLE 2

50 g of NONIPOL 85 (trade name, produced by Sanyo Kasei Kogyo Co., Ltd.) is added to 300 g of 1,2-dibromo-4-(1,2-dibromopropyl)cyclohexane, the mixture is heated to 80° C. for 5–10 minutes until the mixture is fully melted to provide a first solution. In a separate step, 630 g of water is placed into a beaker of 1 liter capacity having a homogenizer, 7 g of carboxymethyl cellulose sodium salt and 12 g of DEMOL N (trade name, produced by Kaoo Soap Co., Ltd.) and the carboxymethyl cellulose sodium salt and DEMOL N are fully dissolved in the water to provide a second solution. The first solution of 1,2-bromo-4-(1,2-dibromopropyl)cyclohexane is dripped into the second solution in the beaker under agitation by the homogenizer to obtain a liquid in which fine particles of the cyclohexane are dispersed in the liquid. The particles have the particle size on the order of 2–3 microns.

EXAMPLE 3

400 g of xylene and 400 g of NONIPOL 120 (trade name, produced by Sanyo Kasei Kogyo Co., Ltd.) are added to 350 g of 1,2,5-tribromo-4-(1,2-dibromomethyl)cyclohexane and the materials are fully stirred to obtain a first uniform solution. In a separate step, 400 ml of water is placed into a beaker of 1 liter capacity having a homogenizer and the solution is dripped into the beaker under agitation by the homogenizer to obtain an emulsion in which particles of 1,2,5-tribromo-4-(1,2-dibromoethyl)cyclohexane on the order of 0.5–1.0 microns are dispersed.

EXAMPLE 4

60 g of cetyl alcohol ethylene with 10 molar oxide added thereto is added to 400 g of 1,2,5-tribromo-4-(2,2,3-tribromobutyl)cyclohexane and the mixture is heated to about 80° C. for 5–10 minutes to completely dissolve 1,2,5-tribromo-4-(2,2,3-tribromoethyl)cyclohexane in cetyl alcohol ethylene to provide a first solution. In a separate step, 513 ml of water is placed into a beaker of 1 liter capacity with a homogenizer, 10 g of casein, 2 g of NaOH (50%) and 15 g of DEMOL N (trade name, produced by Kaoo Soap Co., Ltd.) are placed into the beaker to dissolve the casein, NaOH (50%) and DEMOL N in the water to provide a second solution. The first solution is cooled to a temperature in the range of 90°-100° C., dripped into the beaker under vigorous agitation by the homogenizer to be dispersed in the form of particle in the second solution. The particles are on the order of 2.0-3.5 microns.

TESTS FOR DETERMINING FIRE-RETARDANT PROPERTIES (1)

The testing machine used was a rotary high temperature and pressure dyeing machine. The tests were conducted under the below-given conditions and the results of the tests are shown in Table 1 given hereinbelow.

Test Pieces Used:

Polyester Tropical (woven type) fabrics each having the weight of 180 g/m$^2$ (weight per square meter)

Dyestuffs:

Combination of C.I. (color index) Red 72, C.I. Blue 73 and C.I. Yellow 30. Each dyestuff was used in the amount of 0.3% o.w.f. (0.3% by weight based on the weight of the fabric treated.)

Fire-Retardant Agents:

(a) 10% o.w.f. of emulsions of the agents obtained in Examples 1-3.

(b) 10% o.w.f. of an emulsion of tri(2,3-dichloropropyl)phosphate (TCPP) prepared by emulsifying the phosphate following the procedure as described in Example 1.

(c) 10% o.w.f. of a dispersion of hexabromocyclododecane (HBCD) in liquid prepared by dissolving the hexabromocyclododecane in a liquid following the procedure described in Example 2.

Ratio of Fabric to Bath: 1:10 pH: 5.5 (adjusted with acetic acid)

Temperature and Time:

After the heating of the bath to a temperature in the range of 120°-130° C., the fabric was placed into the bath to be dyed. The fabric was taken out of the bath, subjected to reduction washing (the dyestuff on the fabric was removed by reducing the same with hydrosulfite, NaOH and surface active agent), rinsed in hot water at a temperature in the range of 50°-60° C. for 5-10 minutes twice and then rinsed in water once.

The fire-retardant properties of the fabric after the dyeing operation and the deposition rate of the combined dyestuff on the fabric were determined and the determination results are shown in Table 1.

In the tests, the fire-retardant agents of the present invention afforded flame contact frequency over four times under the dyeing condition of 120° C. for 30 minutes whereas HBCP and TCPP fire-retardant agents require the dyeing condition of temperatures over 130° C. for 30 minutes for obtaining satisfactory dyeing results. The agents of the present invention attained greater deposition rates of combined dyestuff than that attainable by dyeing without any additive fire-retardant agent under the dyeing condition of 120° C. for 30 minutes and exhibited thicker dyeing effect.

TESTS FOR DETERMINING FIRE-RETARDANT PROPERTIES (2)

Carrier dyeing operations were conducted using the inventive and prior art fire-retardant agents under the below-given conditions and the test results are shown in Table 2.

Test Pieces Used:

Polyester taffeta fabrics each having the weight of 609 g/m$^2$ (weight per square meter)

Dyestuffs:

Combination of C.I. Red 60, C.I. Blue 56 and C.I. Yellow 23. Each dyestuff was used in the amount of 0.5% o.w.f. (0.5% by weight based on the weight of the fabric used.)

Carrier:

Carrier MT (manufactured by Daiwa Chemical Kogyo Co., Ltd.) The carrier was used in the amount of 3.09 g per liter of combined dyestuff.

Hard-to-Combustion Property Impartation Agents:

(a) 10% o.w.f. of the emulsified or dispersed agents of Examples 1-4 were employed.

(b) An emulsion of tris(2,3-dichloro propyl)phosphate (DCPP) prepared by emulsifying the phosphate following the procedure described in Example 1. The amount of DCPP was 10% o.w.f.

(c) A dispersion of hexabromo cyclododecane (HBCD) prepared by dispersing the agent in a liquid following the procedure described in Example 2. The amount of HBCD was 10% o.w.f.

Ratio of Fabric to Bath: 1:30 pH: 5.5 (adjusted with acetic acid)

Temperature and Time:

After the heating of the bath to 98° C., the fabric was placed into the bath to be dyed and dyed for 60 minutes. The treated fabric was taken out of the bath and sub-

TABLE 1

| Dyeing Condition | Fire-Retardant Agent | Fire-Retardant Properties Flame Contact Frequency | | | | | Deposition Rate of Combined Dyestuff (%) Red 72 | Blue 73 | yellow 30 |
|---|---|---|---|---|---|---|---|---|---|
| 130° C. for 30 min. | Without agent | 1 | 1 | 1 | 1 | 1 | 100 | 100 | 100 |
| | Agent of Example 1 | 5 | 5 | 5 | 5 | 5 | 100 | 95 | 95 |
| | Agent of Example 2 | 5 | 5 | 5 | 5 | 5 | 95 | 93 | 95 |
| | Agent of Example 3 | 5 | 5 | 5 | 5 | 5 | 100 | 95 | 96 |
| | HBCD | 5 | 4 | 4 | 5 | 5 | 95 | 92 | 93 |
| | TCPP | 4 | 4 | 5 | 4 | 4 | 70 | 65 | 72 |
| 120° C. for 30 min. | Without agent | 1 | 1 | 1 | 1 | 1 | 98 | 75 | 93 |
| | Agent of Example 1 | 5 | 5 | 5 | 5 | 4 | 98 | 90 | 95 |
| | Agent of Example 2 | 5 | 4 | 5 | 5 | 5 | 95 | 94 | 94 |
| | Agent of Example 3 | 5 | 5 | 4 | 4 | 5 | 97 | 89 | 95 |
| | HBCP | 2 | 3 | 4 | 3 | 2 | 95 | 65 | 85 |
| | TCPP | 3 | 3 | 3 | 2 | 3 | 85 | 50 | 80 |

Note:

Fire-Retardant Properties: Coil method set forth in Art. 4, Par. 3 of Enforcement Regulation, the Fire Law.

Deposition Rate of Combined Dyestuff: Relative rate against the deposition amount of combined dyestuff without fire-retardant agent in dyeing at 130° C. for 30 minutes. (Minolta CR-100 chroma meter which can separately determine strengthes of three different colors).

jected to reduction washing and rinsed in hot water and then in water.

TABLE 2

| Fire-Retardant Agent | Fire-Retardant Properties: Flame Contact Frequency | | | | | Deposition Rate of Combined Dyestuff (%): Red 60 | blue 56 | Yellow 23 |
|---|---|---|---|---|---|---|---|---|
| Without agent | 1 | 1 | 1 | 1 | 1 | 100 | 100 | 100 |
| Agent of Example 1 | 4 | 5 | 4 | 5 | 5 | 90 | 90 | 95 |
| Agent of Example 2 | 5 | 5 | 5 | 4 | 4 | 90 | 95 | 95 |
| Agent of Example 3 | 5 | 5 | 5 | 4 | 5 | 95 | 95 | 95 |
| Agent of Example 4 | 5 | 4 | 4 | 5 | 5 | 90 | 90 | 90 |
| HBCD | 1 | 2 | 2 | 1 | 1 | 60 | 55 | 60 |
| TCPP | 2 | 3 | 3 | 3 | 2 | 50 | 50 | 55 |

The fire-retardant agents of the present invention afforded flame contact frequency over four times and attained over 90% of combined dyestuff deposition rate based on that attainable by dyeing bath without any additive fire-retardant agent.

Absorption rates of the inventive and prior art fire-retardant agents were determined for comparison purpose under the below-given conditions and the results of the determinations are shown in FIG. 1.

Dyeing Machine:

Rotary high temperature and pressure dyeing machine Test Pieces Used:

Polyester Tropical fabrics each having the weight of 180 g/m$^2$.

Dyestuffs:

Combination of C.I. Red 72, Blue 73 and Yellow 30. Each dyestuff was used in the amount of 0.3% by weight o.w.f.

Fire-Retardant Agent:

(a) The agent of Example 1 by 10% o.w.f.

(b) An emulsion of tris(1,2-dichloropropyl)phosphate (TCPP) by 10% o.w.f. The emulsion was prepared by emulsifying TCPP in an emulsifying agent following the procedure described in Example 1.

(c) A dispersion of hexabromocyclododecane (HBCD) by 10% o.w.f. The dispersion was prepared by dispersing HBCD in a liquid following the procedure described in Example 2.

Ratio of Fabric to Bath: 1:1 pH: 5.5 (adjusted with acetic acid).

Temperature and Time:

After the heating of the bath to 130° C., the fabric was placed into the bath and dyed for 30 minutes. The treated fabric was taken out of the bath, subjected to reduction washing and rinsed in hot water and then in water.

Determination Method:

The weight of the fabric prior to and after the dyeing was determined, respectively and the absorption rate of the agent was determined from the increment in weight of the fabric.

From FIG. 1, it will be apparent that the absorption rate of brominated alkyl cyclohexane is three times as high as that of brominated cycloalkane and two times as high as that of halogenated phosphoric ester.

Although several specific examples of the invention have been described, many changes and modifications will of course suggest themselves to those skilled in the art. These examples have been selected for this disclosure for the purpose of illustration only. The present invention should therefore not be limited to the examples so selected, the true scope of the invention being defined only in the appended claims.

What is claimed is:

1. A composition for imparting fire-retardant properties to polyester fibers comprising a brominated cyclohexane of the formula

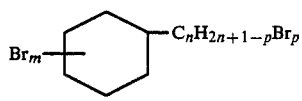

wherein m is an integer of 1–3, n is an integer of 1–4, and p is an integer of 1–3; and at least one surface active agent.

2. A composition according to claim 1, wherein said brominated cyclohexane is selected from the group consisting of 1,2-dibromo-4-(1,2-dibromoethyl)cyclohexane, 1,2-dibromo-4-(1,2-dibromopropyl)cyclohexane, 1,2,5-tribromo-4-(1,2-dibromoethyl)cyclohexane, 1,2,5-tribromo-4-(2,2,3-tribromobutyl)cyclohexane, 2-bromo-4-(2,2,3-tribromobutyl)cyclohexane, 1,2,5-tribromo-4-(bromomethyl)cyclohexane and 1,2-dibromo-4-(dibromomethyl)cyclohexane.

3. A composition according to claim 1, wherein the brominated cyclohexane is 1,2-dibromo-4-(1,2-dibromoethyl)cyclohexane.

4. The composition according to claim 1, wherein the amount of the surface active agent is 10–20% by weight based on the weight of said brominated cyclohexane.

5. A composition according to claim 1, wherein the surface active agent is one or more members selected from the group consisting of lignin sulfonate, aromatic sulfonate, naphthalene sulfonate or esters of said sulfonates, formalin condensate, alkyl phenol, higher fatty acid and higher alcohol with ethylene oxide added thereto.

6. The composition of claim 1 dispersed in water.

7. The composition of claim 5 additionally containing a dyestuff for the polyester fibers.

* * * * *